United States Patent [19]

Miyagawa et al.

[11] Patent Number: 4,482,790

[45] Date of Patent: Nov. 13, 1984

[54] VACUUM INTERRUPTER

[75] Inventors: Hiroshi Miyagawa, Yokohama; Masayuki Kano, Shizuoka, both of Japan

[73] Assignee: Kabushiki Kaisha Meidensha, Tokyo, Japan

[21] Appl. No.: 448,460

[22] Filed: Dec. 10, 1982

[30] Foreign Application Priority Data

Dec. 19, 1981 [JP] Japan ..... 56-190180[U]

[51] Int. Cl.[3] ..... H01H 33/66

[52] U.S. Cl. ..... 200/144 B; 200/302.1

[58] Field of Search ..... 200/144 B, 302

[56] References Cited

U.S. PATENT DOCUMENTS

| | | | |
|---|---|---|---|
| 4,393,286 | 7/1983 | Takagi | 200/144 B |
| 4,408,107 | 10/1983 | Sakuma et al. | 200/144 B |

FOREIGN PATENT DOCUMENTS

| | | | |
|---|---|---|---|
| 0029691 | 3/1981 | European Pat. Off. . | |
| 1428285 | 1/1966 | France . | |
| 147023 | 3/1981 | German Democratic Rep. | 200/144 B |
| 1060994 | 3/1967 | United Kingdom . | |
| 2029643A | 3/1980 | United Kingdom . | |
| 2038559A | 7/1980 | United Kingdom . | |

*Primary Examiner*—A. D. Pellinen
*Assistant Examiner*—Morris Ginsburg
*Attorney, Agent, or Firm*—Pollock, Vande Sande & Priddy

[57] ABSTRACT

A vacuum interrupter (10) has a metallic member (11, 13) for a vacuum envelope and an insulating member (**12*a*, 12*b*) for the vacuum envelope, made of unglazed insulating ceramics. A pair of separable stationary and movable contacts (24, 29) contained in the vacuum envelope. A movable lead rod (16) is rigidly secured to a movable disc-shaped electrode (30) which has the movable contact (29), extending outwardly of the vacuum envelope. Bellows secured in a vacuum-tight manner to the rod (16) and to the vacuum envelope. An impervious insulating film is coated adhesively on atmospheric-side surfaces of the insulating member (12*a*, 12*b*) and of the vacuum-tightly connected portion and vicinity thereof between the insulating member (12*a*, 12*b*) and metallic member (11, 13) for the vacuum envelope. Consequently, the vacuum envelope of the interrupter (10**) is free from adsorbing moisture and pollutant, thereby preventing insulating performance of the envelope from lowering, and highly improving reliablity of vacuum-tightness of the envelope.

9 Claims, 4 Drawing Figures

VACUUM INTERRUPTER

BACKGROUND OF THE INVENTION

The present invention relates to a vacuum interrupter, particularly to a vacuum interrupter of which a vacuum envelope comprises a metallic member and an insulating ceramic member.

As shown in FIG. 1, a vacuum envelope of a conventional vacuum interrupter comprises a circular insulating cylinder 1 as an insulating member, and circular metallic end plates 2 and 3 as metallic members. The insulating cylinder 1 is made of insulating ceramics such as alumina ceramics glazed on an outer surface, or of crystalized glass. The metallic end plates 2 and 3 are made of a Fe-Ni-Co alloy or a Fe-Ni alloy.

An electric stationary lead rod 4 is secured to the metallic end plate 2 coaxially to the insulating cylinder 1 in such a manner that it enters in the insulating cylinder 1 in vaccum-tightness via a circular aperture at a center of the one metallic end plate 2. On an inside end of the stationary lead rod 4, a stationary contact 5 is secured.

An electric movable lead rod 6 is inserted in the insulating cylinder 1 via a circular aperture at a center of the other metallic end plate 3. The movable lead rod 6 is supported in vacuum-tightness by bellows 7, being coaxial to the insulating cylinder 1. On an inside end of the movable lead rod 6, a movable contact 8 is secured.

The stationary and movable contacts 5 and 8 are separable by an axial movement of the movable lead rod 6.

A substantially circular cylindrical arc shield 9 is provided coaxially to the insulating cylinder 1 around the stationary and movable contacts 5 and 8, projecting from the one metallic end plate 2. The arc shield 9, which is made of stainless steel or iron, serves to protect an inner surface of the insulating cylinder 1 from the arcing products generated between the stationary and movable contacts 5 and 8.

In case the insulating cylinder 1 is made of insulating ceramics glazed on the outer surface, it is manufactured through the following steps. The manufacturing steps comprise the step in which a raw materials of glaze is applied by conventional method to an outer periphery of a cylinder made of unglazed insulating ceramics, and the subsequent step in which the cylinder applied with glazing materials is fired to change the applied glazing materials into an impervious glassy film of glaze. This glassy film is capable of protecting the outer periphery of the insulating cylinder 1 from adsorbing moisture and pollutant, thereby preventing an insulating performance of the outer periphery of the insulating cylinder 1 from being reduced.

On the other hand, both of annular end surfaces 1*a* and 1*b* remain unglazed even in the course of forming the glassy film of glaze on the outer periphery of the insulating cylinder 1 by firing.

Metallized layers (not shown) are formed on the unglazed annular end surfaces 1*a* and 1*b*, respectively. The metallic end plates 2 and 3 are directly brazed by conventional method to the metallized layers, respectively.

There are significant problems described hereinafter in manufacturing the insulating cylinder 1, generally, insulating members for a vacuum envelope of a vacuum interrupter.

Since the above glazing materials include some high vapor pressure components such as anhydrous boric acid $B_2O_3$, sodium monoxide $Na_2O$ and potassium monoxide $K_2O$, they are vaporized in a step of vacuum brazing at a temperature between 900° C. and 1050° C. in a vacuum furnace to be deposited on vacuum-room-side surfaces of the insulating members for the vacuum envelope, which reduces an insulating performance of the vacuum-room-side surfaces of the insulating members, and to be deposited on surfaces of interiors of the vacuum furnace, which causes to hinder the continuing operation of the vacuum furnace.

Additionally, when a temporarily assembled vacuum interrupter is set with the glassy film of glaze coated on the outer periphery of the insulating member, in the vacuum furnace, there are inconveniences due to the glassy film of glaze coated thereon, in handling a jig for holding the temporarily assembled vacuum interrupter because the glassy film softens in the brazing process.

Additionally, in the process of making the glazed ceramics through which the glazing materials applied thereto is changed by firing into a glassy film, then, the glazed ceramics coated with glassy film being cooled, there are tendencies to twist the glazed ceramic insulating member for the vacuum envelope and to crack the glassy film, due to the inconsistency of thermal expansion coefficients between the unglazed insulating ceramics and the glassy film of glaze.

In conclusion, many technical difficulties lie in the process that an impervious glassy film which is changed from glazing materials by firing is formed in mass production, high quality and high yield on an atmospheric-side surface of an insulating member for a vacuum interrupter. The technical difficulties and expensiveness of the glaze make the insulating member for the vacuum interrupter considerably expensive.

Even when the desired glassy film is sucessfully formed on an atmospheric-side surface of an insulating member for a vacuum envelope, the following problems are incidental to the full manufactured vacuum interrupter. Metallized layers, as metallized layers (not shown) on the annular end surfaces 1*a* and 1*b*, are formable on a surface of an unglazed portion of insulating ceramics of an insulating member for a vacuum interrupter, but not formable on a glassy film of glaze. Therefore, between the metallized layers on the surface of the unglazed portion of insulating ceramics of the insulating member and the glassy film of glaze on the atmospheric-side surface thereof, a gap of unglazed surface is inevitably formed, which causes to expose the surface of the unglazed insulating ceramics to the atmosphere. The surface of the unglazed insulating ceramics adsorbs moisture and pollutant, which causes insulating performance of the insulating member for the vacuum interrupter to lower, and which causes a brazed portion and its vicinity between the insulating member and the metallic member of the vacuum envelope to be corroded to a vacuum leakage of the vacuum envelope, resulting in the lowered reliability of the vacuum interrupter.

SUMMARY OF THE INVENTION

A primary object of the present invention is to provide a vacuum interrupter of high reliability and low manufacturing cost.

Another object of the present invention is to provide a vacuum interrupter of large insulating performance and high weatherproofness.

Yet another object of the present invention is to provide a vacuum interrupter of which brazed portions and vicinities thereof of a vacuum envelope have improved corrosion resistance.

A still further object of the present invention is to provide a vacuum interrupter of which insulating ceramic member for a vacuum envelope has improved dielectric strength.

According to the vacuum interrupter attaining the objects, the vacuum envelope thereof comprises a metallic member or members and an unglazed insulating-ceramic member or members. The vacuum envelope further comprises an impervious insulating film which is coated on and strongly adhesive to atmospheric-side surfaces of the unglazed insulating-ceramic member for the vacuum envelope, and of the brazed portions and vicinities thereof between the unglazed insulating-ceramic member and the metallic member for the vacuum envelope.

In order to further improve weatherproofness of the vacuum interrupter, the insulating film is formed by applying and drying insulating resin paint of urethane or epoxy resion family.

Additionally, in order to further improve insulating performance of the vacuum interrupter, the insulating film is formed by applying and drying electrically insulating finish varnish.

The other objects and advantages of the present invention will be apparent from the following description, claims and accompanied drawing.

DESCRIPTION OF THE PREFERRED EMBODIMENTS

Figure 2:
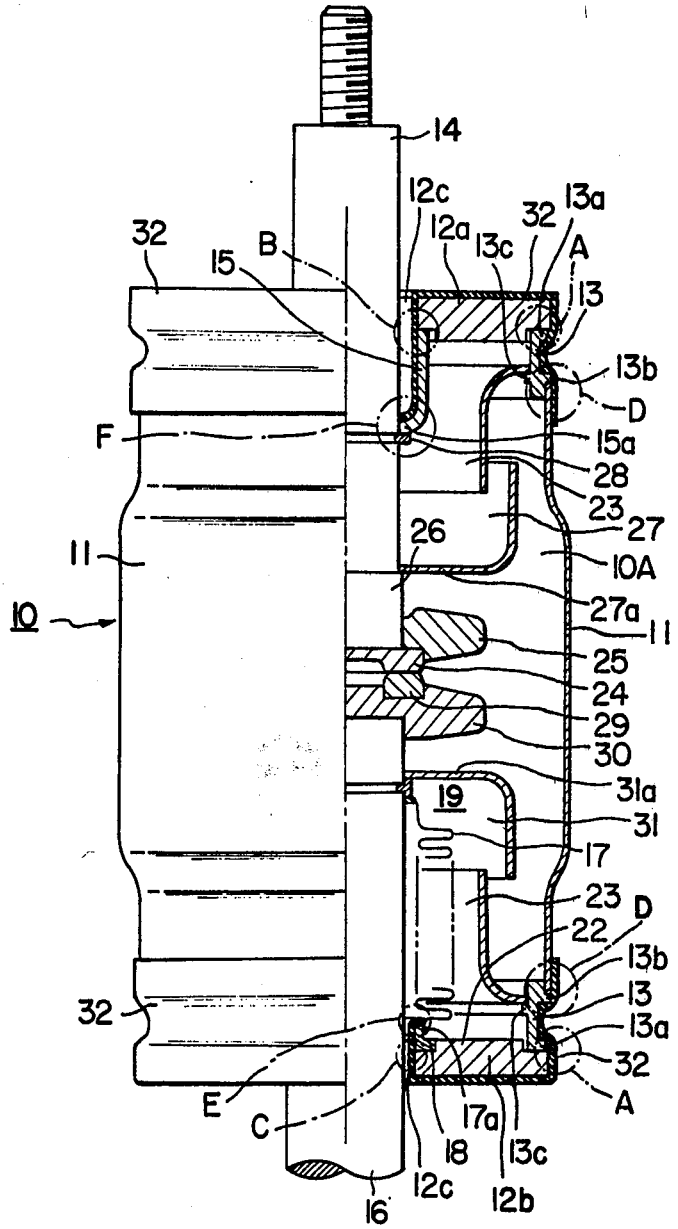
FIG. 2 is a view of a longitudinal half-section of the vacuum interrupter in accordance with one embodiment of the present invention.

A vacuum interrupter, as such as shown in FIG. 2, was invented by Sakuma et al. Inventions concerning the vacuum interrupter were applied for patent on June 24, 1981 in U.S.A. under Ser. No. 276,862 and a U.S. Pat. No. 4,408,107 for the invention was issued on Oct. 4, 1983. The vacuum interrupter by Sakuma et al comprises a hollow metallic circular cylinder and a pair of circular insulating end plates provided at both the ends of the cylinder.

The vacuum interrupter 10 in accordance with one preferred embodiment of the present invention is improved one of the vacuum interrupter invented by Sakuma et al.

As shown in FIG. 2, a vacuum room 10A enclosed by means of a vacuum envelope of the vacuum interrupter 10 is defined by the following members of the vacuum interrupter.

The members of the vacuum interrupter comprise a hollow metallic circular cylinder 11, two insulating end plates 12*a* and 12*b* which are provided respectively near both the ends of the metallic cylinder 11, first auxiliary sealing members 13 in the form of a hollow metallic circular cylinder which are interposed between the metallic cylinder 11 and insulating end plates 12*a* and 12*b* so as to connect the members in vacuum-tightness, a stationary electric lead rod 14, the second auxiliary sealing member 15 in the form of a hollow metallic circular cylinder which serves to connect the stationary lead rod 14 to the insulating end plate 12*a* in vacuum-tightness, a movable electric lead rod 16 which is movable to and from the stationary lead rod 14 along the axis thereof, bellows 17 which is mounted on the movable lead rod 16 within the metallic cylinder 11, the third auxiliary sealing member 18 in the form of a metallic ring which serves to connect an outside end of the bellows 17 to the insulating end plate 12*b* in vacuum-tightness, and the fourth auxiliary sealing member 19 in the form of a metallic ring which serves to braze an inside end of the bellows 17 to the movable lead rod 16 in vacuum-tightness. The vacuum envelope of the vacuum interrupter 10 is completed by vacuum-brazing the contacted surfaces to be brazed of the members of the vacuum interrupter 10 to each other in a high evacuated vacuum furnace.

The above-mentioned members of the vacuum interrupter will be described in order.

The metallic cylinder 11 is made of stainless steel.

Both of the insulating end plates 12*a* and 12*b* which are made of unglazed insulating ceramics, for example, unglazed alumina ceramics are disc-shaped. The outer diameter of the disc shape is substantially identical to those of both the ends of the metallic cylinder 11. The insulating end plates 12*a* and 12*b* are respectively provided at their centers with apertures 12*c* through which the stationary lead rod 14 and the movable lead rod 16 extend into the metallic cylinder 11, respectively.

Figure 3:
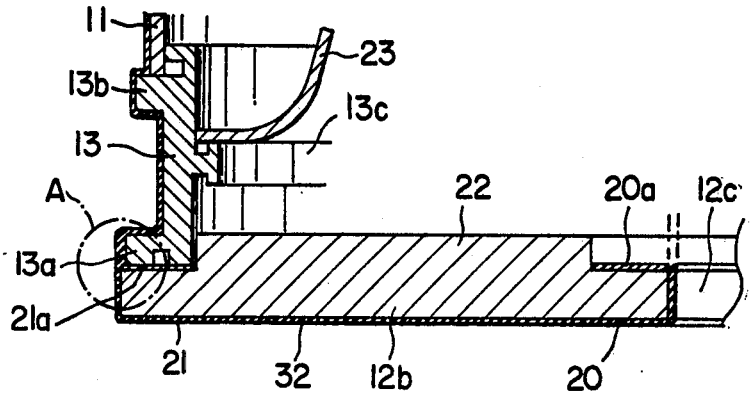
FIG. 3 is an enlarged sectional view of a brazed portion and vicinity thereof between a first auxiliary sealing member and an insulating end plate of the vacuum interrupter of FIG. 2.

As shown in FIG. 3, the vacuum-room-side surface of the insulating end plate 12*b* is provided, around the aperture 12*c* and on the outer periphery of the insulating end plate 12*b* with annular central and outer peripheral shoulders 20 and 21, respectively. The annular central and outer peripheral shoulders 20 and 21 are respectively provided with metallized layers 20*a* and 21*a* for the purpose of facilitating a vacuum-tight brazing. A circularly annular barrier 22 which is projecting in the vacuum room 10A more than both of the central and outer peripheral shoulders 20 and 21, is formed between the central and outer peripheral shoulders 20 and 21.

The first auxiliary sealing member 13 made of Fe-Co-Ni or Fe-Ni alloy or of copper is employed in order to improve reliability of a vacuum-tight sealing between the metallic cylinder 11 and the insulating end plates 12*a* and 12*b* by eliminating, in a plastic deformation of the member 13, thermal stress which is to be caused during a slow cooling process after the vacuum-tight brazing in the vacuum furnace due to different coefficients of thermal expansion between the metallic cylinder 11 and the insulating end plates 12*a* and 12*b*. The auxiliary sealing member made of Fe-Ni-Co or Fe-Ni alloy is usually used because a thermal expansion coefficient of each alloy is nearly same as that of the insulating end plate made of ceramics. The material of the first auxiliary sealing member 13 is preferably copper because copper is inexpensive, relatively large in mechanical strength, and anticorrosive.

The first auxiliary sealing member 13 is provided at its one end with the first outwardly extending flange 13*a* which is brazed to the outer peripheral metallized layer 21*a* of the insulating end plate 12*a* or 12*b*, and in the vicinity of the other end with the second outwardly extending flange 13*b* which is brazed to the annular end surface of the metallic cylinder 11. The first auxiliary sealing member 13 is also provided, between the positions of the first and second outwardly extending flanges 13*a* and 13*b*, with an inwardly extending flange 13*c* supporting an auxiliary shield 23.

The stationary lead rod 14 which is a stepped shaft made of copper or a copper alloy comprises the inside end portion located in the vacuum room 10A, and the outside end extending outwardly of the metallic cylinder 11 through the aperture 12*c* of the insulating end plate 12*a*. A stationary disc-shaped electrode 25 having a stationary contact 24 is rigidly mounted on a periphery of the inside end of the stationary lead rod 14. A bottom 27*a* of an arc shield 27 in the form of a bottomed cylinder is rigidly secured to a periphery of a portion near to the inside end portion of the stationary lead rod 14, being mounted on a shoulder 26 of the stationary lead rod 14.

An inwardly extending flange 15*a* which is formed at the inside end of the second auxiliary sealing member 15 made of copper is brazed to a periphery of a substantially middle portion of the stationary lead rod 14 via a snap ring 28. The annular end surface of the second auxiliary sealing member 15 is brazed to the central metallized layer 20*a* of the insulating end plate 12*a*.

The second auxiliary sealing member 15 made of copper is employed because the stationary lead rod 14 has a shape difficult to be plastically deformed during the slow cooling process after the vacuum-tight brazing, functioning as the first auxiliary sealing member 13.

The movable lead rod 16 which is made of copper or a copper alloy as the stationary lead rod 14, comprises the inside end portion located in the vacuum room 10A, and the outside end extending outwardly of the metallic cylinder 11 through the aperture 12*c* of the insulating end plate 12*b*. A movable disc-shaped electrode 30 which has a movable contact 29 and the shape substantially identical to that of the stationary electrode 25 is rigidly mounted on the inside end portion of the movable lead rod 16. A bottom 31*a* of a bellows shield 31 in the form of a bottomed cylinder is rigidly secured to a periphery of the inside end portion of the movable lead rod 16 via the fourth auxiliary sealing member 19 which is rigidly secured to a periphery of a near portion to the inside end portion of the movable lead rod 16. The bellows shield 31 has the same shape to that of the arc shield and is made of the same material to that thereof.

The bellows 17, made of stainless steel, is provided at the outside end with a brazing cylindrical portion 17*a*. The third auxiliary sealing member 18 made of copper is interposed between the brazing cylindrical portion 17*a* and the central shoulder 20 of the insulating end plate 12*b* via the metallized layer 20*a*. Since the bellows 17 has a thickness of about 0.1 mm, it is negligible for the bellows 17 to have a coefficient of thermal expansion different from the insulating end plate 12*b*. The brazing cylindrical portion 17*a* of the bellows 17, therefore, may be directly brazed to the metallized layer 20*a*. It is, however, preferable to employ the third auxiliary sealing member 18 which during the slow cooling process after the vacuum-tight brazing functions like the first auxiliary sealing member 13, which can secure a high durable and reliable vacuum-tightness between the insulating end plate 12*b* and the brazing cylindrical portion 17*a* of the bellows 17.

The fourth auxiliary sealing member 19 is employed to braze the bellows 17 and the movable lead rod 16 to one another and to support the bellows shield 31, all of which are metals. The fourth auxiliary sealing member 19 must not function like the first auxiliary sealing member 13 during the slow cooling process after the vacuum-tight brazing.

An impervious insulating film 32 is generally formed to cover each atmospheric-side surface of the insulating end plates 12*a* and 12*b*, of the brazed portions and vicinities thereof A between each insulating end plate 12*a* or 12*b*, and the first outwardly extending flanges 13*a* of the first auxiliary sealing members 13, of the brazed portion and vicinity thereof B between the insulating end plate 12*a* and the second auxiliary sealing member 15, and of the brazed portion and vicinity thereof C between the insulating end plate 12*b* and the third auxiliary sealing member 18. Also, the insulating film 32 is generally formed to cover each atmospheric-side surface of the brazed portions and vicinities thereof D between the second outwardly extending flanges 13*b* of the first auxiliary sealing members 13 and the metallic cylinder 11, of the brazed portion and vicinity thereof E between the brazing cylindrical portion 17*a* of the bellows 17 and the third auxiliary sealing member 18, and of the brazed portion and vicinity thereof F between the stationary lead rod 14 and the second auxiliary sealing member 15.

The insulating film 32 is strongly adhesive to any of surfaces of the insulating end plates 12*a* and 12*b* made of unglazed insulating ceramics, of surfaces of the first, second and third metallic auxiliary sealing members 13, 15 and 18 made of copper, of the surfaces of the vicinities of the brazed portions of the metallic cylinder 11, of the surface of the vicinity of the brazed portion of the metallic bellows 17, of the periphery of the vicinity of the brazed portion of the stationary lead rod 14, and of the atmospheric-side surfaces of the solidified brazing metal.

The insulating film 32 which is made from insulating paint and/or varnish is obtainable by applying the insulating paint and/or varnish coated to each predetermined portion of the vacuum interrupter 10 which is taken out of the vacuum furnace after the vacuum brazing, in a clean state of surfaces of the metallic and ceramic members of the vaccum interrupter 10, and then by drying the applied insulating paint and/or varnish spontaneously or by heating. The clean surfaces of the metallic and ceramic members of the vacuum interrupter 10 much improve adhesive strength of the insulating film 32 to them. An insulating resin paint such as an insulating urethane or epoxy resin family paint may preferably be employed as insulating paint. The insulating film 32 made from the paint has specially excellent weatherproofness.

Generally, an insulating film made from insulating varnish has greater adhesive strength, larger suppression to generate pin holes, and greater abrasion resistance than an insulating film made from insulating paint. In the case of the present embodiment, it is preferable to employ an electrically insulating finish varnish of a phenol resin family. The insulating film 32 which is made from an electrically insulating finish varnish of a phenol resin family and is coated to the atmospheric-side surfaces of the unglazed ceramic end plates 12*a* and 12*b*, of the brazed portions and vicinities thereof A, B and C, more increases withstand voltage of the insulating end plates 12*a* and 12*b* than other films made from other insulating varnish or paint, thereby effectively preventing insulating performance of the atmospheric-side surface of the insulating end plate 12*a* or 12*b* from being reduced in the aspect of insulation coordination between the vacuum-room-side and atmospheric-side surfaces of the unglazed ceramic insulating end plates 12*a* and 12*b*.

The insulating film 32 may comprise two layers of an undercoating film made from insulating varnish and an overcoating film from insulating paint. The two-ply insulating film obtains advantages of both of the films from insulating varnish and paint.

Although a residual chlorine which is contaminated in producing process of the insulating paint or varnish is not entirely removable, amount of the residual chlorine is preferably reduced to a trace. This is because the chlorine causes the metallic members of the vacuum envelope to intergranular corrosion in the form of chloride, particularly in the brazed portions and the vicinities thereof A, B, C, D, E and F.

Figure 4:
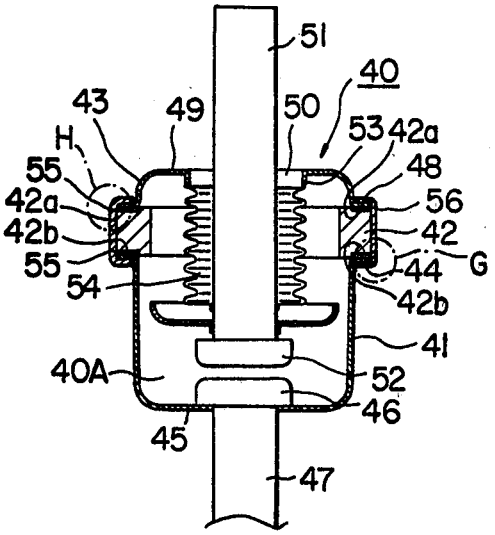
FIG. 4 is a view of a longitudinal section of the vacuum interrupter in accordance with other embodiment of the present invention.

Now, referring to FIG. 4, a vacuum interrupter 40 in accordance with another embodiment of the present invention will be described. A vacuum envelope of the vacuum interrupter 40 comprises a cup-shaped metallic housing 41, a short and circular insulating cylinder 42 which is made of unglazed insulating ceramics, and a metallic cap 43 in the form of a shallow dish.

The metallic housing 41 is provided at the open end with an outwardly extending flange 44, and at the inner surface of the bottom 45 with a stationary contact 46 which is rigidly secured to the inner surface of the bottom 45. The stationary contact 46 is electrically and mechanically connected to a stationary lead rod 47 extending outwardly of the metallic housing 41 through the bottom 45.

The metallic cap 43 is provided at the open end with an outwardly extending flange 48 as the outwardly extending flange 44. The metallic cap 43 has also an aperture 50 at the center of a bottom 49 thereof.

An outside end of a movable lead rod 51 extends outwardly of the metallic cap 43 through the aperture 50. A movable contact 52 is rigidly secured to the inside end of the movable lead rod 51 and located in the vacuum room 40A enclosed by means of the vacuum envelope of the vacuum interrupter 40.

The aperture 50 of the metallic cap 43 is sealed in vacuum-tightness with metallic bellows 54 which is engaged between a boss 53 defining the aperture 50 and the movable lead rod 51.

The insulating cylinder 42 is a short and circular thick walled cylinder which is made of the same material as the insulating end plates 12*a* and 12*b*. Annular end plates 42*a* and 42*b* of the insulating cylinder 42 are provided on the respective outer peripheries with annular metallized layers 55. The outwardly extending flanges 44 and 48 of the metallic housing 41 and of the metallic cap 43 are brazed directly to the metallized layers 55, respectively.

An insulating film 56 is generally formed to cover each atmospheric-side surface of the insulating cylinder 42 made of unglazed ceramics including the outer periphery of the insulating cylinder 42 and the outer peripheries of both the end surfaces 42*a* and 42*b* of the insulating cylinder 42, of a brazed portion and vicinity thereof G between the metallic housing 41 and an annular end plate 42*b* of the insulating cylinder 42, and of a brazed portion and vicinity thereof H between the metallic cap 43 and the annular end plate 42*a* of the insulating cylinder 42. The insulating film 56 has the same structure and characteristics and is produced in the same manner as the insulating film 32 in accordance with the embodiment of FIG. 2.

Figure 1:
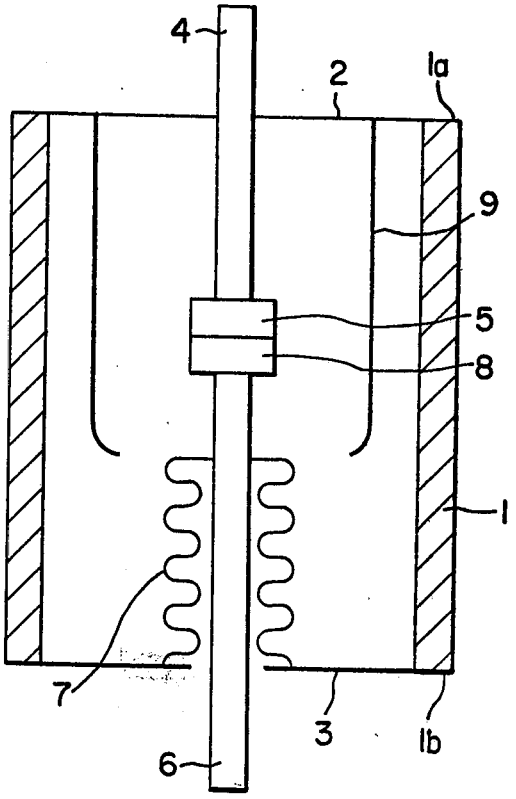
FIG. 1 PRIOR ART
FIG. 1 is a schematic view of a longitudinal section of a conventional type vacuum interrupter.

The present invention is applicable not only to the above-described embodiments, but also to a vacuum interrupter comprising a vacuum envelope which comprises an insulating cylinder and two metallic end plates, for example, as shown in FIG. 1. Also, it is applicable to a vacuum interrupter (not shown) comprising a vacuum envelope which comprises a metallic cylinder and two insulating ceramic end plates brazed directly to the respective end surfaces of the metallic cylinder. Further, it is applicable to a vacuum interrupter comprising a vacuum envelope which comprises a cup-shaped metallic housing and an insulating ceramic end plate brazed directly to the open end of the cup-shaped metallic housing (See European patent publication No. 0029691). Further, it is applicable to a vacuum interrupter (not shown) comprising a vacuum envelope which comprises a cup-shaped metallic housing and an insulating ceramic end plate joined via an auxiliary sealing member to the open end of the housing.

It is apparent to the skilled in this art that the spirit of the present invention will be differently embodied without any deviation from a scope of the invention.

What is claimed is:

1. In a vacuum interrupter having:

(a) a vacuum envelope including a metallic casing member, an insulating means including a ceramic casing member, a stationary electric lead rod, a movable electric lead rod and a metallic bellows, each of the above parts being interconnected in a vacuum environment;

(b) a pair of separable stationary and movable electrodes having a contact junction located in the vacuum envelope;

(c) an inside end of the stationary lead rod rigidly secured to the stationary electrode and said stationary lead rod extending outwardly of the vacuum envelope;

(d) an inside end of the movable lead rod rigidly secured to the movable electrode and said movable lead rod extending outwardly of the vacuum envelope;

(e) one end of the metallic bellows secured to the movable lead rod and another end of said metallic bellows secured to an aperture in the vacuum envelope; the improvement comprising:

(f) said metallic casing member being brazed in the vacuum environment to a metallized layer provided on an unglazed insulating ceramic for said insulating casing member when in a high evacuated vacuum furnace;

(g) an impervious insulating film coated adhesively to each clean state atmospheric-side surface by means of vacuum brazing of said unglazed insulating ceramic, a connecting portion and a vicinity thereof between said unglazed insulating ceramic and said metallic casing member.

2. The vacuum interrupter of claim 1 wherein said unglazed insulating ceramic has the shape of a hollow cylinder.

3. The vacuum interrupter of claim 1 wherein said unglazed insulating ceramic has a disc shape.

4. The vacuum interrupter of claim 1 wherein said insulating film is made from an insulating paint including varnish.

5. The vacuum interrupter of claim 1 wherein said insulating film is made from an insulating paint of an urethane resin family.

6. The vacuum interrupter of claim 1 wherein said insulating film is made from an insulating paint of an epoxy resin family.

7. The vacuum interrupter of claim 1 wherein said insulating film is made from an insulating varnish.

8. The vacuum interrupter of claim 7 wherein said insulating varnish is an electrically insulating finish varnish of a phenol resin family.

9. The vacuum interrupter of claim 1, wherein said metallic casing member is a metallic hollow cylinder, said insulating means including another ceramic casing member and comprising a pair of disc-shaped end plates which are provided near both ends of the metallic hollow cylinder, one end of said bellows being brazed to said movable lead rod and another end of the bellows being brazed to an aperture of one of the disc-shaped end plates, first auxiliary sealing members respectively interposed in a vacuum-tight manner between the metallic hollow cylinder and both of the insulating end plates, and a second auxiliary sealing member interposed in a vacuum-tight manner between another insulating end plate and said stationary lead rod.

* * * * *